US005955231A

United States Patent [19]

Yasuda et al.

[11] Patent Number: 5,955,231

[45] Date of Patent: Sep. 21, 1999

[54] ELECTROPHOTOGRAPHIC APPARATUS AND ELECTROPHOTOGRAPHIC PHOTORECEPTOR EMPLOYED BY THE SAME

[75] Inventors: Kenichi Yasuda, Hachioji; Noboru Unagiike, Koufu, both of Japan

[73] Assignee: Konica Corporation, Japan

[21] Appl. No.: 09/209,665

[22] Filed: Dec. 10, 1998

[30] Foreign Application Priority Data

Dec. 15, 1997 [JP] Japan ..... 9-344866

[51] Int. Cl.[6] ..... G03G 5/10

[52] U.S. Cl. ..... 430/69; 430/56; 430/58

[58] Field of Search ..... 430/56, 69

[56] References Cited

U.S. PATENT DOCUMENTS

| | | | |
|---|---|---|---|
| 4,492,745 | 1/1985 | Mimura et al. | 430/56 |
| 4,514,483 | 4/1985 | Matsuura et al. | 430/69 |
| 5,080,993 | 1/1992 | Maruta et al. | 430/69 |
| 5,166,023 | 11/1992 | Harada et al. | 30/69 |
| 5,223,363 | 6/1993 | Shozi | 430/69 |
| 5,707,726 | 1/1998 | Ohtaka et al. | 430/69 |
| 5,800,956 | 9/1998 | Minemura et al. | 430/69 |

FOREIGN PATENT DOCUMENTS

| | | | |
|---|---|---|---|
| 2733187 | 1/1978 | Germany | 430/69 |
| 59-228255 | 12/1984 | Japan | 430/69 |
| 5-313394 | 11/1993 | Japan | 430/69 |
| 6-118679 | 4/1994 | Japan | 430/69 |

*Primary Examiner*—Roland Martin

*Attorney, Agent, or Firm*—Jordan B. Bierman; Bierman, Muserlian and Lucas

[57] ABSTRACT

An electrophotographic apparatus in which image formation is carried out by repeating charging, dot exposure, development, transfer, separation, and cleaning wherein the electrophotographic apparatus employs a photoreceptor composed of a support having thereon a photosensitive layer, and in which the machined circumferential surface, which is regularly formed in the direction along with the center axis of cylindrical support, satisfies Formula 1 below.

$$L/A=n+(0.35 \text{ to } 0.65) \qquad \text{Formula 1}$$

wherein

L: machined cycle width ($\mu$m)

A: recording dot pitch n: integer of 0 or more

The electrophotographic apparatus is obtained which causes neither interference fringes or streaking due to the unevenness of the coating layer and the machined substrate surface.

10 Claims, 2 Drawing Sheets

ELECTROPHOTOGRAPHIC APPARATUS AND ELECTROPHOTOGRAPHIC PHOTORECEPTOR EMPLOYED BY THE SAME

FIELD OF THE INVENTION

The present invention relates to an electrophotographic photoreceptor employed in copiers, printers, and the like, and an electrophotographic apparatus using the same.

In recent years, for image forming apparatuses such as copiers, printers, and the like, high image quality has been increasingly demanded. Furthermore, digital image forming, employing laser beam exposure, etc., has been actively developed.

In an electrophotographic photoreceptor, when the charge generating layer has small absorbance for illuminant light having wavelengths employed for image exposure, and the absorbance is not more than two, interference fringes are liable to be caused due to the unevenness of the coating layer.

In order to minimize the interference fringes, one method is known in which the surface of the substrate (a support) is further roughened (as disclosed in such as, for example, Japanese Patent Publication Open to Public Inspection Nos. 60-225854 and 3-62039). However, along with a roughened surface, streak defects are caused and interference fringes are caused due to the machined surface.

Specifically, this phenomenon is likely to occur when, without decreasing the number of exposure recording dots to achieve a high image quality, a latent image forming process is carried out in which gradation is generated employing pulse duration modulation to vary the laser beam diameter. Thus it has been required to solve this problem to achieve the high image quality.

SUMMARY OF THE INVENTION

An object of the present invention is to provide an electrophotographic photoreceptor in which, when the absorbance of a charge generating layer is small for an illuminant light having employed wavelengths, interference fringes, caused due to the unevenness of the coating layer, are stably minimized and the generation of interference fringes and streak defects due also minimized, and an electrophotographic apparatus employing the same.

Employing an electrophotographic photoreceptor, in an electrophotographic apparatus in which image formation is carried out by charging, dot exposure, development, transfer, separation, and cleaning, an electrophotographic apparatus employing the photoreceptor which comprises a support having thereon a photosensitive layer, and in which the machined circumferential surface, which is regularly formed in the direction along with the center axis of cylindrical support, satisfies Formula 1 below.

$$1L/A=n+(0.35 \text{ to } 0.65) \qquad \text{Formula 1}$$

L: machined cycle width ($\mu$m)

A: recording dot pitch n: integer of 0 or more

An electrophotographic photoreceptor is preferably employed in which the above-mentioned machined circumferential surface satisfies Formula 2 below.

$$S/Rz \leqq 0.7 \qquad \text{Formula 2}$$

subpeak S: 0.7 $\mu$m or less surface roughness Rz: 0.5 to 2.5 $\mu$m

DETAILED DESCRIPTION OF THE INVENTION

The inventors found that when the interference fringes, caused due to the surface of a substrate, which appeared in the form of longitudinal fringes in the drum rotating direction were such that the same wave form as the substrate surface was regularly arranged, were likely to be caused when the cycle is near by integer times of dot pitch, and the problem was solved in the range of conditions of Formula 1.

At the same time, the inventors found that at the time, in order to more effectively minimize the interference fringes (moire) caused due to the unevenness of the coating layer, which appeared irrespective of the rotation direction, a ratio of surface roughness (Rz) to subpeak (S) preferably satisfied Formula 2, and in order to effectively minimize the streaking, the subpeak was preferably adjusted to 0.7 $\mu$m. According to these findings, in such an electrophotographic photoreceptor that the absorbance of the charge generating layer becomes not more than 2.0, an electrophotographic photoreceptor suitable for an electrophotographic apparatus is obtained which causes neither interference fringes nor streaking due to the unevenness of the coating layer and the machined substrate surface.

$$L/A=n+(0.35 \text{ to } 0.65) \qquad \text{Formula 1}$$

L: machined cycle width ($\mu$m)

A: recording dot pitch ($\mu$m)

n: integer of 0 or more $$S/Rz \leqq 0.7 \qquad \text{Formula 2}$$

surface roughness Rz=0.5 to 2.5 $\mu$m subpeak S$\leqq$0.7 $\mu$m

Figure 1:
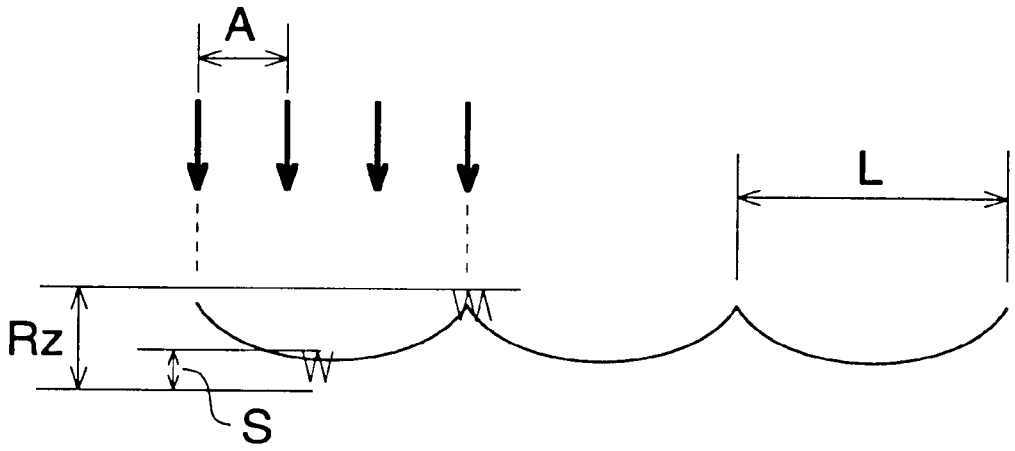
FIG. 1 is a view to explain the surface of the photoreceptor support according to the present invention.

In these Formulas, L, as shown in FIG. 1, is a machined cycle width which is formed when the surface of the support is machined employing a bit, and usually between 10 and 400 $\mu$m on the surface of the support which is presently employed in an electrophotographic photoreceptor. A is the recording dot pitch, that is, the distance between the centers of dots in the laser dot recording, etc. Namely, the recording dot pitch becomes 84.67 $\mu$m at 300 dpi dot exposure and 42.44 $\mu$m at 600 dpi exposure. Is an integer of 0 or more, preferably 0 to 3.

Furthermore, the surface roughness Rz represents the maximum height of the total of irregularities due to bit machining and other irregularities (subpeak S) due to other reasons.

Figure 2:
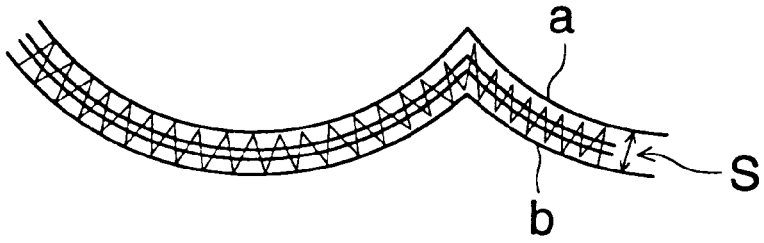
FIG. 2 a view to explain subpeaks of the photoreceptor support.

The value of the subpeaks denotes the shortest interval distance between the subpeak's upper surface curve (line a) parallel to the main curve of the regular sectional shape as shown in FIG. 2 and the subpeak's lower surface curve (line b) parallel to the same.

The surface roughness Rz is preferably between 0.5 and 2.5 μm. In order to minimize the formation of moire patterns, Rz is preferably not less than 0.5, and in order to minimize the formation of streaking, it is preferably not more than 2.5.

S/Rz is preferably not more than 0.7 because the formation of moire patterns is minimized by not uniformly orienting the phase of reflected light on the substrate surface in the boundary of the charge generating layer and the subbing layer.

Still further, the subpeak width is preferably not more than 0.7 μm in order to minimize the formation of streaking by improving the unevenness of the coating layer, which is caused when the subpeaks become large.

The material for the photoreceptor substrate is not particularly limited. Aluminum and alloys thereof are widely employed.

An interlayer (occasionally termed a subbing layer) is generally provided within the substrate. Representative materials employed in such a layer include ceramic series compounds comprised of silane coupling agents or organic chelate compounds and resin series compounds comprised of polyamide series resins, etc.

A photosensitive layer is provided on the subbing layer. The photosensitive layer may be a single-layered or multi-layered structure. However, the preferred structure is a so-called function separation type multi-layered structure comprised of a charge generating layer and a charge transport layer.

The charge generating layer (CGL) is often prepared by dispersing a charge generating material (CGM), if desired, into the binder resin. Coincidentally, there is no particular limitation on the CGM. However, as CGMs, preferably employed are metal or metal-free phthalocyanine compounds (more preferred compounds are titanylphthalocyanines and hydroxypotassiumphthalocyanines, and the most preferred compounds are titanylphthalocyanines having a maximum peak at 27.2° of Bragg angle 2θ for a Cu-Kα line), or anthanthrone compounds. Further, these compounds may be employed in combinations of two or more.

Acceptable binder resins employed in the charge generating layer include, for example, polystyrene resins, polyethylene resins, polypropylene resins, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymer resins which comprise at least two repeating units of these resins, for example, vinyl chloride-vinyl acetate copolymer resins, vinyl chloride-vinyl acetate-maleic acid anhydride copolymer resins, or organic polymer semiconductors, for example, poly-N-vinyl carbazole, etc.

The charge transport layer (CTL) is composed of a charge transport material alone, or the material along with a binder resin. CTMs include, for example, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly-N-vinyl carbazole, poly-1-vinyl pyrene, poly-9-vinyl anthracene, etc. These compounds may be employed individually or in combination.

Furthermore, as binder resins which can be employed in the charge transport layer, when concerned in claim 1, are listed, for example, polycarbonate resins, polyacrylic resins, polyester resins, polystyrene resins, styrene-acrylonitrile copolymer resins, methacrylic acid ester resins, styrene-methacrylic acid ester copolymer resins, etc.

Figure 3:
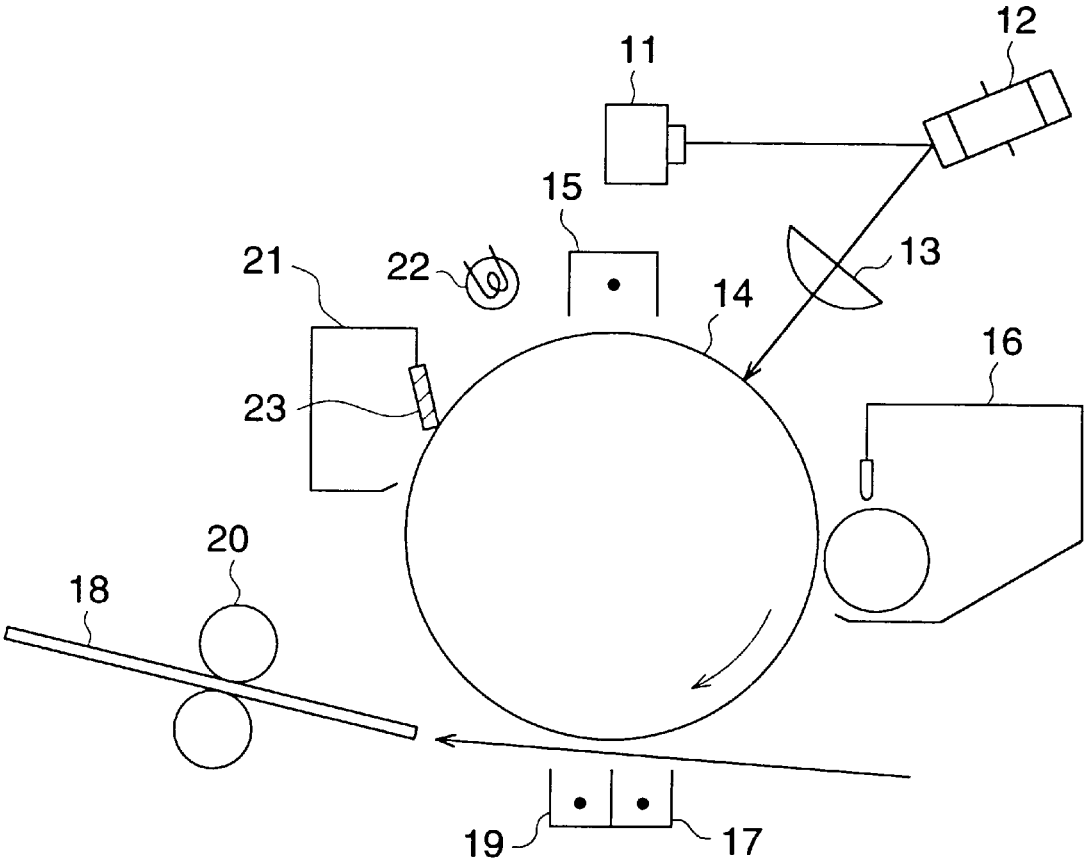
FIG. 3 is a sectional view of a constitution showing one example of the electrophotographic apparatus of the present invention.

An example of a digital copier is shown in FIG. 3, below and the shown electrophotographic apparatus is explained.

In FIG. 3, based on information read by an original document reading apparatus not shown, exposure light is emitted from semiconductor laser source 11. The exposure light is bent into the vertical direction against a paper surface in FIG. 3 employing polygonal mirror 12 and irradiated onto the surface of a photoreceptor via an fθ lens which compensates for image distortion to form an electrostatic latent image. The photoreceptor is previously and uniformly charged employing charging device 15, and starts clockwise rotation while matching image exposure timing.

A latent image on the surface of the photoreceptor is developed employing development unit 16, and the resultant developed image is transferred to transfer material 18 conveyed under matching timing, employing the function of transfer device 17. Further, photoreceptor 14 and the transfer material 18 are separated by separation device (separation electrode) 19, while the developed image is transferred to the transfer material 18 and borne by the same, and fed to fixing device 20 and fixed.

Untransferred toner, etc. remaining on the surface of the photoreceptor is cleaned by cleaning device 21; the residual charge is removed by pre-transfer exposure (PCL) 22, and the photoreceptor is then uniformly recharged employing charging device 15 in order to form a subsequent image.

The representative transfer material is common paper. However, the material includes those onto which prefixed developed image can be transferred, for example, a PET base for an over-head projector, etc.

As the cleaning blade 23, a 1 to 30 mm thick rubber like elastic material is commonly employed. As the material, urethane rubber is most frequently employed. When this material is employed in pressure contact with the photoreceptor, heat is readily transmitted. Accordingly, the cleaning blade is preferably not in contact with the photoreceptor by providing a retracting mechanism during non-image forming operations.

The present invention relates to an apparatus which forms an electrostatic latent image on a photoreceptor, employing a modulated beam modulated by digital data from an image firming method and apparatus, specifically being a computer, utilizing an electrophotographic method.

Recently, in the field of electrophotography, etc. in which an electrostatic latent image is formed on a photoreceptor and the resulting latent image is developed to form a visible image, research and development have been actively carried out on an image forming method utilizing a digital system in which improvement in image quality, conversion, edition, etc. are easily carried out and high quality image formation is commercially viable.

There are apparatuses in which as a scanning optical system in which light modulation is carried out employing digital image signals from a computer applied to this image forming method and apparatus or a copying original document, an acoustic optical modulator is inserted in a laser optical system and light is modulated employing the above-mentioned acoustic optical modulator, and laser intensity is directly modulated employing a semiconductor laser. From these scanning optical systems, spot exposure is carried out onto the uniformly charged surface of a photoreceptor to form a dotted image.

Radiated beam from the above-mentioned scanning optical system forms a circular or elliptic luminance distribution similar to normal distribution with the bottoms broadened in the right and left directions, and for example, in the case of laser beam, generally, the distribution in either the main scanning direction or the subscanning direction on the photoreceptor, or both show extremely narrow circular or elliptic form with 20 to 100 $\mu$m.

EXAMPLES

In the following, the present invention is explained in detail with reference to examples.

Preparation of Electrophotographic Photoreceptor

Examples 1 through 5 and Comparative Examples 1 through 4

Base Body Machining

A diameter 100 mm aluminum tube was machined employing a cutting bit having an R shaped top, and by regulating bit top radius R, polishing conditions of a diamond chip adhered onto the bit top, and a bit driving speed (mm/rev), base bodies were prepared which were different in relationship (L/A) between the machining cycle width L and the recording dot pitch A of an image evaluation device, subpeak S, and S/Rz.

Subbing Layer

| | |
|---|---|
| Aramin CM 8000 (manufactured by Tory Co., Ltd.) | 90 weight parts |
| Methanol | 2400 weight parts |
| 2 -Butanol | 600 weight parts |

Aramin CM 8000 was placed in a solvent consisting of methanol and 2-butanol and dissolved to prepare a subbing layer solution.

An aluminum base body was subjected to operation of dip and elevation in the resulting subbing layer solution to obtain a subbing layer with a thickness of 0.4 $\mu$m.

Charge Generating Layer

| | |
|---|---|
| (G-1) Y type titanyl-phthalocyanine | 80 weight parts |
| Silicone resin KR-5240 | 900 weight parts |

-continued

| | |
|---|---|
| (manufactured by Shin-Etsu Kagaku Co., Ltd.) | |
| 2-Butanone | 2000 weight parts |

were mixed and dispersed for 10 hours in a sand mill to prepare a charge generating layer coating composition. The resulting composition was dip-coated onto the above-mentioned subbing layer to prepare a 0.23 $\mu$m thick charge generating layer having an absorbance of 1.2 at the wavelength of exposure light.

Charge Transport Layer

| | |
|---|---|
| (T-1) charge transport material | 320 weight parts |
| Bisphenol Z-type poly-carbonate Z-300 (manufactured by Mitsubishi Gas Kagaku Co., Ltd.) | 480 weight parts |
| 1,2-Dichloroethane | 4000 weight parts |

were mixed and dissolved to prepare a charge transfer coating composition. The resulting coating composition was dip-coated onto the above-mentioned charge generating layer and was subjected to thermal treatment at 100° C. for one hour to prepare a 25 $\mu$m thick charge transport layer.

G-1

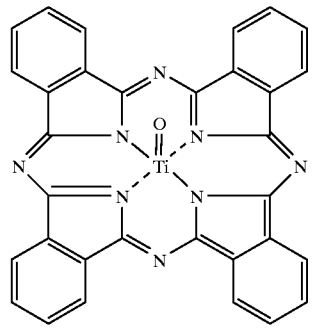

The above-mentioned CGM-1 is crystalline Y type titanylphthalocyanine having peaks at 9.5±2°, 24.1±0.2°, and 27.2±0.20 of Bragg angle 2θ in X-ray diffraction spectra for Cu-K line.

T-1

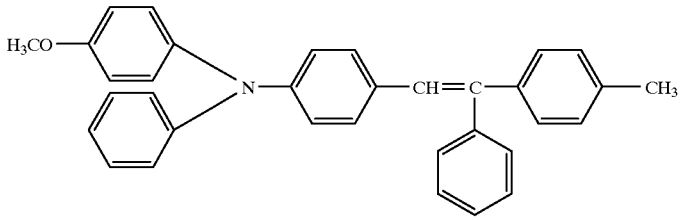

Evaluation

Image evaluation was carried out employing a digital copier, Konica KL 2010, manufactured by Konica Corp.

An Image for evaluation was such that at 300 dpi, a laser beam diameter was varied employing driving pulse width modulation and the image density was adjusted to 70 to 80 employing L* of the L*, a*, and b* dye system.

Table 1 shows the evaluation results.

TABLE 1

| | L/A | Rz (μm) | S (μm) | Evaluation Results: Moire Patterns (wavy) | Step Patterns (due to machining) | Streaking |
|---|---|---|---|---|---|---|
| Example 1 | 0.62 | 0.71 | 0.45 | A | A | A |
| Example 2 | 1.36 | 1.5 | 0.50 | A | A | A |
| Example 3 | 1.52 | 1.6 | 0.37 | A | A | A |
| Example 4 | 1.63 | 1.9 | 0.66 | A | A | A |
| Example 5 | 2.6 | 1.75 | 0.42 | A | A | A |
| Example 6 | 2.36 | 1.85 | 0.60 | A | A | A |
| Example 7 | 0.42 | 0.96 | 0.40 | A | A | A |
| Comparative Example 1 | 0.99 | 0.7 | 0.21 | B | C | A |
| Comparative Example 2 | 1.31 | 1.83 | 0.53 | A | C | B |
| Comparative Example 3 | 1.69 | 1.78 | 0.55 | A | C | B |
| Comparative Example 4 | 2.9 | 1.92 | 0.52 | A | C | B |

Evaluation Standards
A: no generation of image defects is found
B: slight generation is found
C: generation is easily found Photoreceptors of Examples 1 through 5 were capable of forming excellent images in which there were not found any formation of interference fringes (step patterns) due to machining cycle, interference fringes (moire patterns) due to the unevenness of the coating layer, and streaking (caused by abrupt unevenness of the coating layer due to machined surface). On the contrary, Comparative Examples 1 through 4, which were prepared beyond the conditions of the present invention, were caused by image defects of any of the interference fringes (step patterns) due to machining cycle, the interference fringes due to the unevenness of the coating layer, and streaking. Thus the advantages of the present invention are shown.

The present invention can provide an electrophotographic photoreceptor in which when the absorbance of a charge generating layer is small for an illuminant light having employed wavelengths, interference fringes caused due to the unevenness of the coating layer is stably minimized and the generation of interference fringes and streaking defects due to substrate machining to improve the surface roughness, are also minimized, and an electrophotographic apparatus employing the same.

REFERENCE NUMERALS IN THE DRAWINGS

11 Semiconductor laser beam source
12 Polygonal mirror
14 Photoreceptor
15 Charging device
16 Development device
17 Transfer device
18 Transfer material
19 Separation electrode
20 Fixing device
21 Cleaning device
22 Pretransfer exposure (PCL)
23 Cleaning blade
A Recording dot pitch
L Machining cycle width
S Subpeak value

We claim:

1. An electrophotographic apparatus in which image formation is carried out by charging, dot exposure, development, transfer, separation, and cleaning wherein the electrophotographic apparatus employs a photoreceptor comprising a support having thereon a photosensitive layer, and in which the machined circumferential surface, which is regularly formed in the direction along with the center axis of cylindrical support, satisfies Formula 1 below $$L/A = n + (0.35 \text{ to } 0.65) \qquad \text{Formula 1}$$

wherein

L: machined cycle width (μm)

A: recording dot pitch n: integer of 0 or more.

2. The electrophotographic apparatus of claim 1 wherein the machined cycle width L is 10 to 400 μm.

3. The electrophotographic apparatus of claim 1 wherein n is 0 to 3.

4. The electrophotographic apparatus of claim 1 wherein the machined circumferential surface satisfies Formula 2 below.

$$S/Rz \leqq 0.7 \qquad \text{Formula 2}$$

wherein subpeak S: 0.7 μm or less surface roughness Rz: 0.5 to 2.5 μm.

5. The electrophotographic apparatus of claim 1 wherein the material for the photoreceptor substrate is aluminum and alloys thereof.

6. The electrophotographic apparatus of claim 1 wherein the photoreceptor substrate comprises a subbing layer between the substrate and the photosensitive layer.

7. The electrophotographic apparatus of claim 6 wherein the subbing layer comprises a ceramic compound.

8. The electrophotographic apparatus of claim 7 wherein the ceramic compound is silane coupling agent or organic chelate compound.

9. The electrophotographic apparatus of claim 7 wherein the subbing layer comprises a resin compound.

10. The electrophotographic apparatus of claim 9 wherein the resin compound is polyamide resins.

* * * * *